US005680994A

United States Patent [19]

Eide et al.

[11] Patent Number: 5,680,994

[45] Date of Patent: Oct. 28, 1997

[54] MILL FOR GRINDING GARBAGE OR THE LIKE

[75] Inventors: Russel L. Eide; Eric P. Eide; Russel L. Eide, II, all of Mondovi, Wis.

[73] Assignee: Wastenot International Ltd., Nassau, Bahamas

[21] Appl. No.: 53,522

[22] Filed: Apr. 26, 1993

Related U.S. Application Data

[63] Continuation-in-part of Ser. No. 649,658, Feb. 1, 1991, Pat. No. 5,205,500, which is a continuation-in-part of Ser. No. 400,095, Aug. 29, 1989, Pat. No. 4,989,796, which is a continuation-in-part of Ser. No. 377,712, Jul. 10, 1989, Pat. No. 5,067,661.

[51] Int. Cl.[6] ..... B02E 13/18

[52] U.S. Cl. ..... 241/19; 241/79.1; 241/275; 241/154

[58] Field of Search ..... 241/154, 275, 241/285.1, 46.01, 19, 79.1, 54

[56] References Cited

U.S. PATENT DOCUMENTS

| | | | |
|---|---|---|---|
| 248,923 | 11/1881 | Déchamp | 241/154 |
| 1,212,419 | 1/1917 | Sturtevant | 241/154 |
| 1,619,295 | 3/1927 | Gardner | 241/19 |
| 1,669,239 | 5/1928 | Grindle . | |
| 1,758,010 | 5/1930 | Pettinos | 241/154 |
| 1,798,465 | 3/1931 | Grindle . | |
| 1,875,531 | 9/1932 | Walton | 241/19 |
| 2,093,703 | 9/1937 | Blodgett | 241/154 X |
| 2,174,630 | 10/1939 | Hardinge | 241/54 X |
| 2,355,784 | 8/1944 | Dondlinger | 241/56 X |
| 2,392,958 | 1/1946 | Tice | 241/285 R X |
| 2,639,747 | 5/1953 | Burn et al. . | |
| 2,700,512 | 1/1955 | Denovan et al. | 241/56 X |
| 2,787,108 | 4/1957 | Meltzer . | |
| 2,940,738 | 6/1960 | Posener et al. | 241/282.1 X |
| 3,065,919 | 11/1962 | Burkett et al. . | |
| 3,160,354 | 12/1964 | Burkett | 241/275 |

(List continued on next page.)

FOREIGN PATENT DOCUMENTS

| | | | |
|---|---|---|---|
| 532773 | 3/1991 | European Pat. Off. . | |
| 384236 | 4/1908 | France . | |
| 2423669 | 11/1975 | Germany . | |
| 3144071 | 5/1983 | Germany . | |
| 1080854 | 3/1984 | U.S.S.R. | 241/154 |
| 1126320 | 11/1984 | U.S.S.R. . | |
| 688523 | 3/1953 | United Kingdom . | |

*Primary Examiner*—Douglas D. Watts

*Attorney, Agent, or Firm*—Peterson, Wicks, Nemer & Kamrath, P.A.

[57] ABSTRACT

A mill (10) for grinding garbage is disclosed including an octagonal shaped grinding chamber (26). Grinding rotors (48–50) are rotatably fixed to a rotatable shaft (44). An impeller rotor (51) is also rotatably fixed to the shaft (44) below the grinding rotors (48–50). The impeller rotor (51) discharges a stream of air, entrapped material, and projectiles into a projectile deflection device (182) which includes an upwardly sloping bottom plate (202) which deflects the projectiles into an end plate (204) to reduce the kinetic energy thereof. The air stream and entrapped material pass from the projectile deflection device (182) into a plenum (210) which reduces the velocity of the air stream to release much of the entrapped material, with the material release being enhanced by baffles (224) providing a tortuous path for the air stream in the plenum (210) before it enters a cyclonic material separator (216). Material anti-wrap provisions (140) in the form of wing plates (152, 154, 156) radially extending from semicylindrical carriers (**142*a*, 142*b*) are provided between the top plate (28) and the first rotor (48), between the first and second rotors (48, 49), and between the second and third rotors (49, 50). Deflector bars (164) are attached to the axial ends of the wing plates (152, 154, 156) to prevent migration of any wrapped material therebeyond. The upper axial ends of the anti-wrap provisions (140) are positioned within the axial extent of cylindrical deflectors (168) mounted to the top plate (28) and the first and second rotors (48, 49**).

23 Claims, 6 Drawing Sheets

U.S. PATENT DOCUMENTS

| | | | |
|---|---|---|---|
| 3,490,704 | 1/1970 | Bourne et al. | 241/154 |
| 3,555,996 | 1/1971 | Schwarz et al. . | |
| 3,873,034 | 3/1975 | Iwahori et al. . | |
| 3,987,970 | 10/1976 | Burkett | 241/154 X |
| 4,030,670 | 6/1977 | Abernathy . | |
| 4,098,466 | 7/1978 | MacElvain et al. . | |
| 4,117,655 | 10/1978 | Smith . | |
| 4,144,167 | 3/1979 | Burkett et al. | 241/154 X |
| 4,151,794 | 5/1979 | Burkett | 241/154 X |
| 4,472,928 | 9/1984 | Easton . | |
| 4,493,459 | 1/1985 | Burkett | 241/154 X |
| 4,593,861 | 6/1986 | Blakley et al. | 241/257.1 X |
| 4,637,561 | 1/1987 | Edberg | 241/154 |
| 4,690,338 | 9/1987 | Sayler et al. | 241/154 X |
| 5,192,029 | 3/1993 | Harris . | |
| 5,236,133 | 8/1993 | Lundguist | 241/79.1 |

MILL FOR GRINDING GARBAGE OR THE LIKE

CROSS REFERENCE

This application is a continuation-in-part of application Ser. No. 07/649,658 filed Feb. 1, 1991, now U.S. Pat. No. 5,205,500, which is a continuation-in-part of application Ser. No. 07/400,095 filed Aug. 29, 1989, now U.S. Pat. No. 4,989,796, which is a continuation-in-part of application Ser. No. 07/377,712 filed Jul. 10, 1989, now U.S. Pat. No. 5,067,661.

BACKGROUND

The present invention generally relates to mills for grinding material and particularly to grinding mills for garbage or like material.

A critical problem is the disposal of solid waste which is generated every day in today's society. A common method of solid waste disposal is landfills. However, the volume of landfills is limited and the accessibility to close landfills is becoming more restricted. Thus, a need has arisen to expand the amount of garbage that landfills can accept to extend the life of such landfills.

One method to extend the landfill life is to reduce the compacted volume of the garbage. This is performed by grinding the garbage to reduce the garbage volume by 4 to 1 or more and thereby extending the life of a landfill by that ratio. By composting the ground or processed material, the garbage volume may be further reduced in the order of one half and thereby further extending the life of the landfill. Further, by utilizing high oxygenation of the processed material to invite the growth of aerobic bacteria, the problem of methane gas production existing in current landfills can be reduced and practically eliminated.

Further, many systems for recovering reusable material from garbage or like material requires the garbage to be ground before the garbage is subjected to the various recovery processes.

Thus, a need exists for mills for grinding garbage or like material which is able to grind the garbage to the desired size and to do so efficiently and economically. Such mills should be economical to manufacture and should be able to withstand the forces associated with grinding garbage or encountered when grinding objects which may be found in garbage.

SUMMARY

The present invention solves this need and other problems in grinding garbage or like material by providing, in one aspect, a mill including a plurality of planar grinding rotors which are rotatably fixed to a shaft rotatably mounted in a grinding chamber, with the grinding rotors located parallel to, complementary to, and intermediate the inlet opening of the grinding chamber and a plurality of planar shelves.

In another aspect of the present invention, the mill includes a plurality of grinding rotors rotatably fixed to a shaft rotatably mounted in a grinding chamber, with planar shelves being located in the grinding chamber complementary to the grinding rotors, and further including an impeller rotor rotatably fixed to the shaft and located intermediate the plurality of grinding rotors and the outlet opening for forcing the ground material passing around the grinding rotors out the outlet opening. In the preferred form, the grinding rotors include members for enhancing the creation of a vacuum by the impeller rotor and the movement of light weight ground material through the mill.

In a further aspect of the present invention, the spacing through which the material must pass decreases as the material passes through the grinding rotors of the mill. In a preferred form, the radial spacing of the free ends of the arms of the grinding rotors from the grinding chamber decreases from the grinding rotor adjacent the inlet opening of the grinding chamber to the outlet opening of the grinding chamber. Likewise, in the preferred form, the radial spacing between the planar discs of the grinding rotors from the centrally located apertures of the shelves of the grinding chamber decreases from the grinding rotor adjacent the inlet opening of the grinding chamber to the outlet opening of the grinding chamber.

In a still further aspect of the present invention, deflectors are provided in the grinding chamber for deflecting material located generally concentric with the grinding rotors toward the grinding rotors for preventing any tendency of material to simply circle the grinding rotors inside of the mill.

In the preferred form of the present invention, the housing of the mill is formed by four planar side plates interconnected together by their side edges to have a square cross section and by four planar corner plates interconnected by their side edges to adjacent side plates, with the grinding chamber of the mill being defined by the side plates and the corner plates.

In yet a further aspect of the present invention, a multiplicity of wear plates are abutted with the sides of the housing intermediate the intersections of the housing sides in the preferred form by elongated bars which are retained adjacent to the housing plates, with the wear plates preventing internal wear of the housing plates from the grinding operation.

In further aspects of the present invention, the stream of air and entrapped material exit the mill into a plenum where the stream of air is slowed down to release at least portions of the entrapped material before the stream of air enters a material separator which further releases the entrapped material from the stream of air.

In another aspect of the present invention, a chute portion is provided such that projectiles exiting from the mill are deflected off a deflector plate arranged at an acute angle to the path of the projectile and towards an end plate before the projectile exits the outlet of the chute portion.

In yet other aspects of the present invention, wing plates are mounted to extend radially from a rotating shaft at circumferentially spaced locations to effectively increase the circumference of the rotating shaft to combat wrapping of material around the shaft. In the most preferred form, the wing plates are solely mounted by first and second semicylindrical carriers secured together and sandwiching the Shaft therebetween.

In still other aspects of the present invention, deflector bars are secured to the axial ends of the wing plates of the anti-wrap device to prevent migration of material beyond the axial ends of the wing plates.

In further aspects of the present invention, the upper axial ends of the wing plates are located within the axial extent of a deflector for preventing material from axially entering the upper axial end of the wing plates and for covering any exposed portions of the shaft extending beyond the upper axial ends of the wing plates.

It is thus an object of the present invention to provide a novel mill for grinding.

It is further an object of the present invention to provide such a novel grinding mill for garbage.

It is further an object of the present invention to provide such a novel grinding mill which may be operated efficiently and economically.

It is further an object of the present invention to provide such a novel grinding mill which is economical to manufacture.

It is further an object of the present invention to provide such a novel grinding mill having deflectors provided in the grinding chamber for deflecting material towards the grinding rotors.

It is further an object of the present invention to provide such a novel grinding mill including a novel housing formed by four planar side plates interconnected together by their side edges to have a square cross section and by four planar corner plates interconnected by their side edges to adjacent side plates.

It is further an object of the present invention to provide such a novel grinding mill which is manufactured from stock materials.

It is further an object of the present invention to provide such a novel grinding mill which avoids the use of cast components.

It is further an object of the present invention to provide such a novel grinding mill able to withstand the forces associated with grinding garbage or encountered when grinding objects which may be found in garbage.

It is further an object of the present invention to provide such a novel grinding mill formed by planar rotors formed of planar components which are arranged parallel to planar shelves of a grinding chamber.

It is further an object of the present invention to provide such a novel grinding mill including a propeller or an impeller type rotor to force the ground material out the outlet opening and to draw the material through the mill.

It is further an object of the present invention to provide such a novel grinding mill including members provided on the grinding rotors for enhancing the vacuum created by the impeller rotor and the movement of the ground material through the mill.

It is further an object of the present invention to provide such a novel grinding mill having decreasing spacing through which the ground material must pass through the grinding rotors of the mill.

It is further an object of the present invention to provide such a novel grinding mill having a dust control system.

It is further an object of the present invention to provide such a novel grinding mill having a composting bacteria inoculation system.

It is further an object of the present invention to provide such a novel grinding mill having provisions for preventing internal wear of the housing from the grinding operation.

It is further an object of the present invention to provide such a novel grinding mill having internal wear preventing provisions formed from stock materials and only requiring cutting to size.

It is further an object of the present invention to provide such a novel grinding mill reducing the kinetic energy of projectiles before their exposure to downstream material transfer means and personnel in the vicinity of the mill.

It is further an object of the present invention to provide such a novel grinding mill wherein the air is classified in a plenum after exiting the mill and before it enters a material separator to allow the material separator to be of a smaller size and to operate at higher efficiencies.

It is further an object of the present invention to provide such a novel grinding mill Which effectively increases the circumference of the rotating shaft to combat wrapping of material thereon.

It is further an object of the present invention to provide such a novel grinding mill which prevents axial migration of wrapped material on the rotating shaft.

It is further an object of the present invention to provide such a novel grinding mill which covers any exposed portions of the shaft extending beyond the upper axial end of the anti-wrap device.

It is further an object of the present invention to provide such a novel grinding mill which prevents material from axially entering the anti-wrap device.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
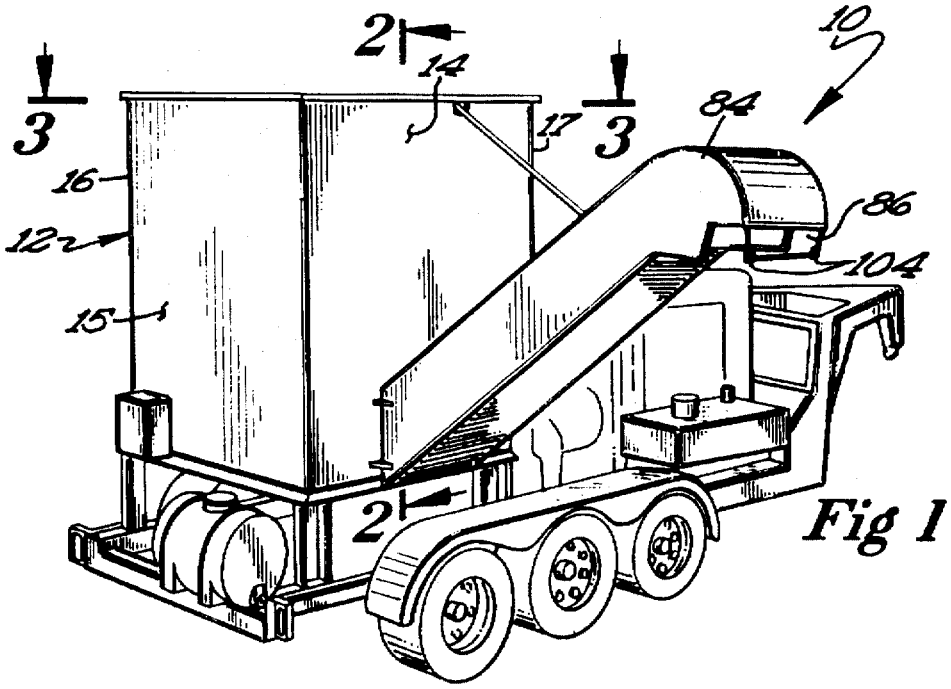
FIG. 1 shows a perspective view of a garbage grinding mill according to the preferred teachings of the present invention.
Figure 2:
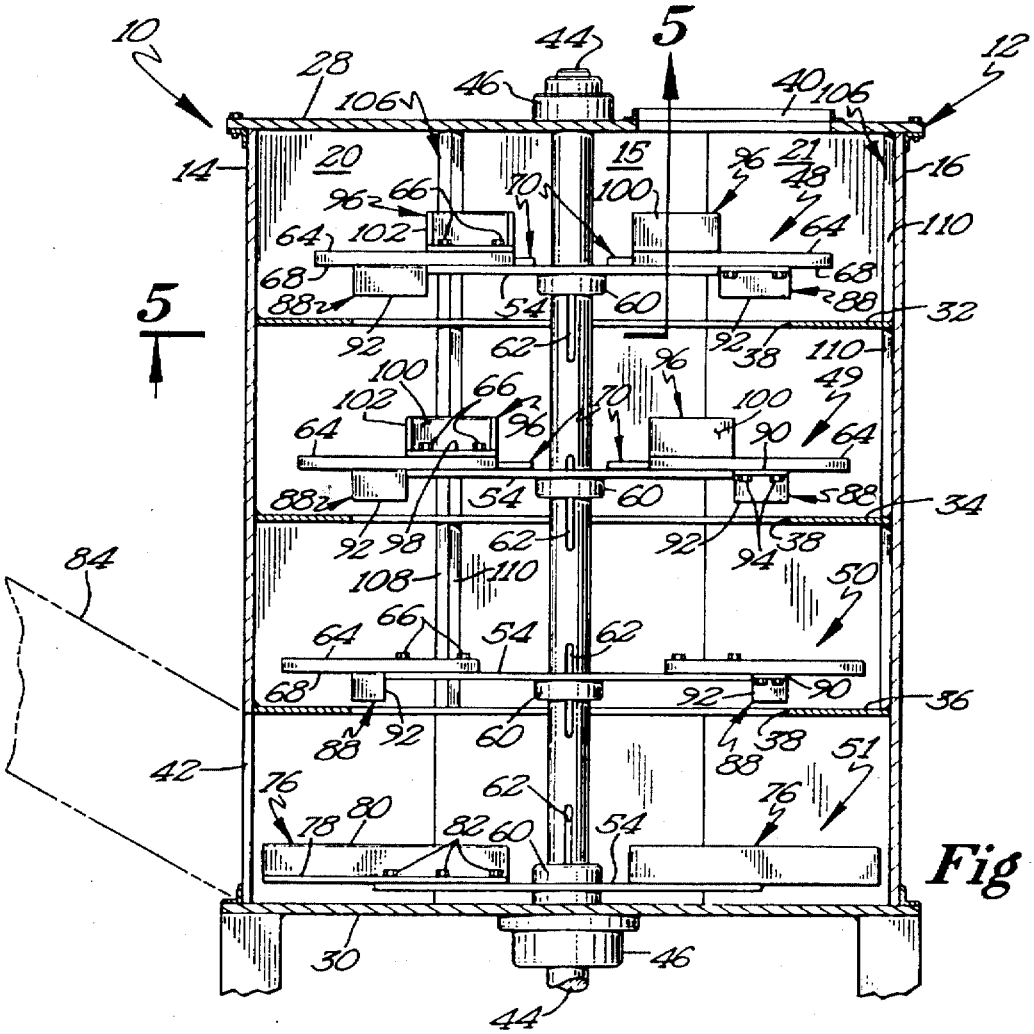
FIG. 2 shows a partial, cross-sectional view of the garbage grinding mill of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "upper", "lower", "vertical", "horizontal", "rearward", "ends", "side", "edge", "axial", "radial", and similar terms are used herein, it should be understood that these terms have reference only to the structure shown in the drawings as it would appear to a person viewing the drawings and are utilized only to facilitate describing the invention.

DESCRIPTION

A mill according to the most preferred teachings of the present invention for processing, resizing, or grinding solid waste, sorted recycled materials such as glass, tin, plastic, aluminium, or paper products, garbage, or like material is shown in the drawings and generally designated 10. In the most preferred form of mill 10 shown in FIG. 1, mill 10 is shown mounted on a trailer for portability. It can be appreciated that mill 10 according to the teachings of the present invention can be constructed for permanent installation. Mill 10 includes a housing 12 which is generally cylindrical in configuration. In the most preferred form, housing 12 includes four flat or planar, generally rectangular side plates 14, 15, 16, and 17 which are interconnected together by their side edges to have a square cross section. Housing 12 further includes four flat or planar, generally rectangular plates 20, 21, 22, and 23 which are interconnected by their side edges to adjacent side plates 14, 15, 16, and 17 at 45° angles. Plates 14–17 and 20–23 define a grinding chamber 26 having an octagonal cross section, and in the most preferred form the sides of the octagonal cross section have equal lengths and have equal angles therebetween. Housing 12 further includes a top plate 28 and bottom plate 30 attached to the upper and lower ends of plates 14–17 and 20–23.

Chamber 26 of housing 12 is divided into sections by horizontal shelves 32, 34, and 36 secured in chamber 26. Specifically, each of shelves 32, 34, and 36 have an octagonal periphery complementary to and for attachment to the octagonal sides of chamber 26. Each of shelves 32, 34, and 36 further include centrally located apertures 38. Apertures 38 of shelves 32, 34, and 36 in the most preferred form are of the same size. An inlet opening 40 to chamber 26 is formed in top plate 28. An outlet opening 42 from chamber 26 is formed in plate 14 intermediate plates 20 and 23 and below shelf 36.

It can then be appreciated that housing 12 is believed to be particularly advantageous. For example, housing 12 is of a strong design, with plates 20–23 acting as braces between plates 14–17. Further, shelves 32, 34 and 36 are of identical construction to reduce manufacturing set-up and inventory. Furthermore, housing 12 can be easily and rapidly manufactured and assembled with less tolerances than required to manufacture and assemble an octagonal housing as an example.

Mill 10 further includes a shaft 44 rotatably mounted in chamber 26 concentrically within apertures 38 of shelves 32, 34, and 36. In the most preferred form, shaft 44 is rotatably mounted by bearings 46 located in top and bottom plates 28 and 30. Shaft 44 may be driven in any suitable manner. For example, in the most preferred form, shaft 44 extends from chamber 26 beyond bottom plate 30 and includes a suitable drive connection such as a v-belt pulley which in turn can be driven by any suitable means such as an electric motor or an internal combustion engine.

Mill 10 further includes rotors 48, 49, 50, and 51 rotatably fixed to shaft 44 and located complementary to and intermediate opening 40 of chamber 26 and shelves 32, 34 and 36 and bottom plate 30 and in the most preferred form are located above shelves 32, 34, and 36 and bottom plate 30 respectively. Rotors 48–51 each include a circular, flat or planar disc 54 having a central opening 56 and a circular periphery 58. A hub 60 which is longitudinally adjustable but rotatably fixed on shaft 44 along a keyway 62 is located within and attached to opening 56 of disc 54. Discs 54 of rotors 48–50 have a size less than the size of apertures 38 of shelves 32, 34, and 36 and which increases from rotor 48 to rotor 50, with disc 54 of rotor 48 being smaller than disc 54 of rotor 49 and with disc 54 of rotor 49 being smaller than disc 54 of rotor 50.

Rotors 48–50 are in the form of grinding rotors and further include a multiplicity of arms 64 dynamically mounted on and extending radially from discs 54 and circumferentially spaced from each other. Arms 64 are elongated and flat or planar and have a generally rectangular cross section. In the most preferred form, arms 64 are of the same length in rotors 48–50 but are attached to discs 54 such that the radial extent of the free ends of arms 64 from shaft 44 increase from rotor 48 to rotor 50 with the free ends of arms 64 of rotor 48 extending from shaft 44 a radial distance less than the free ends of arms 64 of rotor 49 and with the free ends of arms 64 of rotor 49 extending from shaft 44 a radial distance less than the free ends of arms 64 of rotor 50. In the most preferred form, arms 64 are horizontal and attached to discs 54 by bolts 66 extending through arms 64 and discs 54, with the first or bottom surface 68 of arms 64 abutting directly with the top surface of discs 54.

Bracing structures 70 are further provided in rotors 48 and 49 intermediate arms 64. Specifically, structures 70 are wedge shaped having a thickness which in the preferred form is less than the thickness of arms 64. The bottom surfaces of wedge shaped bracing structures 70 abut directly with the top surfaces of discs 54 and are secured thereto such as by welding and plug welding. The side edges 72 of structures 70 abut directly with the side edges 74 of adjacent arms 64. Arms 64 are then located in a trough formed by adjacent bracing structures 70. It can then be appreciated that discs 54 and bracing structures 70 provide abutment and force transferring support for arms 64, with bolts 66 accepting force on arms 64 in a direction out of the trough formed by adjacent bracing structures 70. Thus, the amount and direction of force to which bolts 66 are subjected in operation are greatly restricted according to the teachings of the present invention. In the most preferred form, disc 54 of rotor 48 may have a greater thickness than discs 54 of rotors 49–51 for increased strength.

Rotors 48–50 are positioned upon shaft 44 above and parallel to shelves 32, 34, and 36, with the vertical or axial spacing of rotors 48–50 above shelves 32, 34, and 36 decreasing from rotor 48 to rotor 50, with the vertical spacing between rotor 48 and shelf 32 being greater than the vertical spacing between rotor 49 and shelf 34 and with the vertical spacing between rotor 49 and shelf 34 being greater than the vertical spacing between rotor 50 and shelf 36. Arms 64 of rotors 48–50 extend radially past apertures 38 and over shelves 32, 34, and 36, with the radial extent which arms 64 extend onto shelves 32, 34, and 36 increasing or in other words the radial spacing of the free ends of arms 64 from chamber 26 decreasing due to the increasing radial extent of the free ends of arms 64 from shaft 44 of rotors 48–50 respectively. Discs 54 of rotors 48–50 are located radially within apertures 38 of shelves 32, 34, and 36, with the radial spacing between discs 54 and apertures 38 decreasing from rotor 48 and shelf 32 to rotor 50 and shelf 36 due to the increasing size of discs 54 of rotors 48–50.

Rotor 51 is in the form of a propeller or an impeller located intermediate the plurality of grinding rotors 48–50 and outlet opening 42 for forcing ground material from grinding rotors 48–50 out of outlet opening 42. In the preferred form, impeller rotor 51 includes a multiplicity of arms 76 dynamically mounted and radially extending from disc 54 and circumferentially spaced from each other. In the most preferred form, arms 76 are formed from angle iron and specifically include a first side 78 and a second side 80. The first end of side 78 abuts directly with the top surface of disc 54 and attached thereto such as by bolts 82 extending through side 78 and disc 54. Side 80 upstands generally perpendicular from disc 54.

Mill 10 further includes a chute 84 extending from outlet opening 42 of chamber 26 to a chute opening 86.

Now that the basic construction of mill 10 according to the preferred teachings of the present invention has been explained, the operation, further enhancements, and subtle features of the present invention can be set forth and appreciated. Specifically, shaft 44 and rotors 48–51 rotatably fixed thereto are rotated. Garbage can then can be introduced through inlet opening 40 by any suitable means such as by a conveyor, not shown. Upon entry into chamber 26, the garbage is impinged by arms 64 of rotor 48 which then breaks or grinds the garbage. It can then be appreciated that to pass rotor 48 and shelf 32, the garbage must pass between arms 64 of rotor 48 which are rotating thus greatly restricting passage therethrough and/or must pass between the free ends of arms 64 of rotor 48 and plates 14–17 and 20–23 defining the walls of chamber 26 and between arms 64 of rotor 48 and shelf 32 and through aperture 38 of shelf 32. It can then be appreciated that the garbage must have been reduced to a physical size before passage is allowed as set forth.

When the garbage passes through aperture 38 of shelf 32, the garbage is impinged by arms 64 of rotor 49 which then further breaks or grinds the garbage. It can then be appreciated that to pass rotor 49 and shelf 34, the garbage must pass between arms 64 of rotor 49 which are rotating thus greatly restricting passage therethrough and/or must pass between the free ends of arms 64 of rotor 49 and plates 14–17 and 20–23 defining the walls of chamber 26 and between arms 64 of rotor 49 and shelf 34 and through aperture 38 of shelf 34. It can then be appreciated that the garbage must have been reduced to a physical size before passage is allowed as set forth. It should be further appreciated that due to the decreasing radial spacing between the free ends of arms 64 of rotor 49 and chamber 26, the decreasing vertical spacing between rotor 49 and shelf 34, and the decreasing radial spacing between disc 54 of rotor 49 and aperture 38 of shelf 34 than the corresponding spacings of rotor 48 and shelf 32, the physical size of the ground garbage passing through aperture 38 of shelf 34 is generally smaller than the physical size of the ground garbage passing through aperture 38 of shelf 32.

When the garbage passes through aperture 38 of shelf 34, the garbage is impinged by arms 64 of rotor 50 which then further breaks or grinds the garbage. It can then be appreciated that to pass rotor 50 and shelf 36, the garbage must pass between arms 64 of rotor 50 which are rotating thus greatly restricting passage therethrough and/or must pass between the free ends of arms 64 of rotor 50 and plates 14–17 and 20–23 defining the walls of chamber 26 and between arms 64 of rotor 50 and shelf 36 and through aperture 38 of shelf 36. It can then be appreciated that the garbage must have been reduced to a physical size before passage is allowed as set forth. It should be further appreciated that due to the decreasing radial spacing between the free ends of arms 64 of rotor 50 and chamber 26, the decreasing vertical spacing between rotor 50 and shelf 36, and the decreasing radial spacing between disc 54 of rotor 50 and aperture 38 of shelf 36 than the corresponding spacings of rotor 49 and shelf 34, the physical size of the ground garbage passing through aperture 38 of shelf 36 is generally smaller than the physical size of the ground garbage passing through aperture 38 of shelf 34.

When garbage passes through aperture 38 of shelf 36, rotor 51 acts as an impeller blowing or forcing the garbage through outlet opening 42 of chamber 26, through chute 84, and out of chute opening 86. It can further be appreciated that rotor 51 acting as an impeller creates a vacuum inside of chamber 26 which acts to suck the garbage from above rotor 51 and around and between rotors 48–50 and shelves 32, 34, and 36.

As a large percentage of garbage is paper or other light weight products such as from packaging, there may exist a tendency for particles when ground from such paper or other light weight products to float above the rotating grinding members. The vacuum created by impeller rotor 51 sucks these light weight particles around and between rotors 48–50 and shelves 32, 34, and 36 and through mill 10 out of chute 84. To enhance the creation of a vacuum and the movement of light weight particles through mill 10, mill 10 according to the preferred teachings of the present invention further includes flaps 88 secured axially intermediate arms 64 and shelves 32, 34, and 36 and radially intermediate discs 54 and aperture 38 of shelves 32, 34 and 36 and particularly in the preferred form to bottom surface 68 of arms 64 of grinding rotors 48–50. In the most preferred form, flaps 88 are formed by an angled member including first and second flat portions 90 and 92 which are interconnected together by an obtuse angle in the order of 150°. Flat portion 90 of flaps 88 abuts directly with bottom surface 68 of arm 64 and is attached thereto such as by bolts 94. Flat portion 92 extends downwardly and rearwardly from portion 90 in a direction opposite to the direction of rotation of arms 64 and rotors 48–50. Thus, upon rotation of rotors 48–50, flaps 88 further create a downward movement of air through chamber 26. The number and location of flaps 88 provided in mill 10 can then be varied according to the actual vacuum created by rotor 51, the type of material which is to be ground, and like factors. It can be appreciated that too much vacuum is undesirable as the material may be pulled through mill 10 before being ground to the desired size. For example, flaps 88 may be provided only on selected arms 64 rather than on all arms 64 of a particular rotor 48–50, with flaps 88 being provided on diametrically opposite arms 64 in rotors 48–50. Likewise, flaps 88 may be omitted from rotor 48 to reduce the impingement area as rotor 48 initially impinge the incoming garbage, and the like.

As generally arms 64 must impinge the garbage for a grinding action to occur and as generally the bulk of the ground material must pass around the free ends of rotors 48–50, mill 10 further includes pusher bars 96 secured to the top surface of arms 64 of rotors 48 and 49 radially inside of discs 54. In the most preferred form, bars 96 are formed of angle iron including first and second flat portions 98 and 100 attached generally perpendicular thereto and triangular end braces 102 attached to the opposite ends for providing additional support for portion 100. Flat portion 98 of bars 96 abuts directly with the top surface of arm 64 and is attached thereto such as by bolts 66 which secure arms 64 to discs 54. Flat portion 100 extends generally perpendicular from the top surface of arm 64. Pusher bars 96 push any material which may have a tendency to collect around shaft 44 and on top of disc 54 radially outwardly to where the grinding action occurs. It should be noted that unground garbage entering chamber 26 through opening 40 may directly engage bars 96 of rotor 48 and/or relatively large sized material only partially ground may engage bars 96 of rotors 48 and 49, bars 96 should have the necessary strength to allow continued operation without fatigue or failure, with end braces 102 enhancing this strength and part longevity. The number and location of pusher bars 96 provided in mill 10 can then be varied according to the type of material which is to be ground and like factors. For example, pusher bars 96 may be provided only on selected arms 64 rather than on all arms 64 of rotors 48 and 49, with pusher bars 96 being on diametrically opposite arms 64 in rotors 48–50. Likewise, due to the generally ground nature of the material reaching rotor 50 and the proximity to impeller rotor 51 and the vacuum created thereby, pusher bars 96 have been omitted from rotor 50 in the preferred form.

Mill 10 further includes provisions for controlling dust from the ground material exiting opening 86 of chute 84 under the windage created by impeller rotor 51. In the most preferred form, first and second nozzles 104 are suspended from chute 84 below opening 86 and generally outside of the path of material exiting from opening 86. Nozzles 104 spray a flat, wide angle of water into the path of material exiting from opening 86 to wet down the material. The water can be supplied to nozzles 104 by pipe water pressure or by an electric pump. If the ground material is going to be composted, nozzles 104 may further inoculate the ground material with a composting bacteria to reduce the time necessary for composting.

In the most preferred form, disc 54 of rotor 49 and shelf 32, disc 54 of rotor 50 and shelf 34, and disc 54 of rotor 51 and shelf 36 are each cut from a single piece of flat material to maximize material useage. Further, disc 54 of rotor 48 in the preferred form is formed of thicker material than discs 54 of rotors 49–51 for increased strength to initially engage and grind the garbage entering chamber 26.

Mill 10 according to the teachings of the present invention is able to effectively and efficiently grind garbage. Particularly, mill 10 utilizes the sharp edges of ground materials such as glass, metal, and hard plastic found in containers, cans, and the like moving inside of chamber 26 and hitting each other and other material to increase the grinding action of rotors 48–50 of mill 10.

Figure 3:
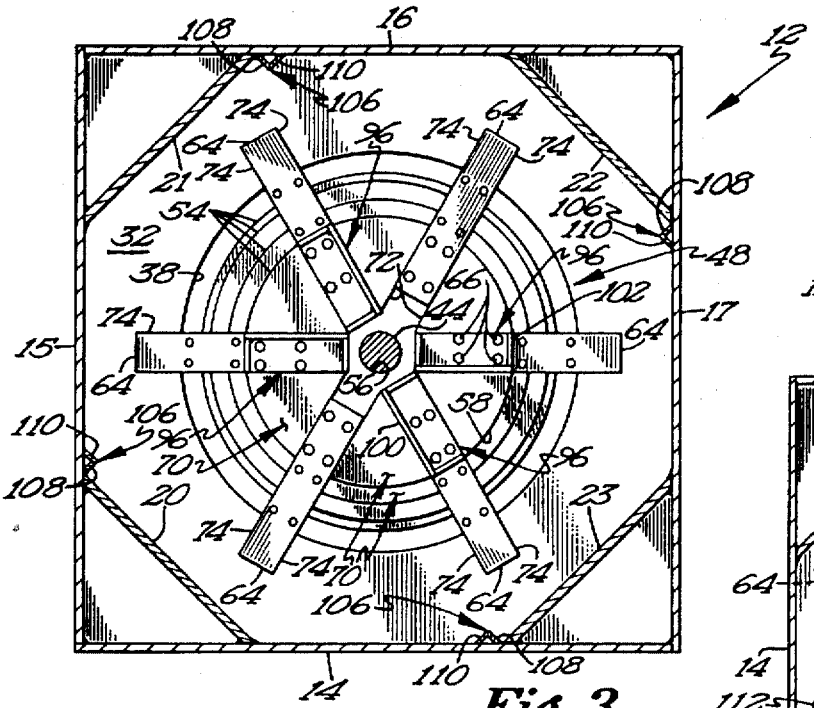
FIG. 3 shows a cross-sectional view of the garbage grinding mill of FIG. 1 according to section line 3—3 of FIG. 1.

According to the preferred teachings of the present invention, mill 10 also includes provisions for preventing any tendency of material to simply circle grinding rotors 48–50 inside of mill 10 concentric to grinding rotors 48–50 and adjacent to the walls and perimeter of grinding chamber 26. In a first preferred form, deflectors 106 are provided for deflecting material from adjacent the perimeter of grinding chamber 26 towards the rotating grinding rotors 48–50 during operation of mill 10. In the preferred form, deflectors 106 are provided attached to plates 14–17 forming chamber 26. In the most preferred form, deflectors 106 are formed of angle iron of a length to fit between top plate 28 and shelves 32, 34, and 36. Deflectors 106 generally include first and second plates 108 and 110 integrally connected along their first edges at right angles and having equal widths. The free, second edges of first plates 108 of deflectors 106 are interconnected to chamber 26 such as by welding generally at the interconnection of plates 20–23 to plates 14–17. The free, second edges of second plate 108 are interconnected to chamber 26 such as by welding to plates 14–17 at a location spaced from but parallel to the interconnection of plates 20–23 to plates 14–17. In the most preferred form, four deflectors 106 are provided circumferentially spaced equadistant around chamber 26 for each grinding rotor 48–50, specifically at the interconnection of the adjacent sides of the octagonal shaped grinding chamber 26, and particularly at the trailing edges of plates 20–23 relative to the rotation of grinding rotors 48–50 which in FIG. 3 of the drawings is clockwise. It should be noted that the number of deflectors 106 provided should not restrict the flying of material around in grinding chamber 26 and the grinding action caused by the sharp edges of ground material hitting each other.

It should be noted that plate 108 is arranged generally parallel to shaft 44 and generally perpendicular to grinding rotors 48–50 and specifically plate 108 has an axial height which is a multiple of the axial height of side edges 74 of arms 64 and of grinding rotors 48–50, with the height in the preferred form being generally equal to the spacings between top plate 28 and shelves 32, 34, and 36.

It is believed that the particular form and location of deflectors 106 according to the teachings of the present invention in use in an octagonal shaped grinding chamber 26 is advantageous. Specifically, plates 14–17 and 20–23 defining grinding chamber 26 generally are at a 45° angle relative to each other due to the regular octagonal shape. Similarly, due to the equal width of plates 108 and 110 and their perpendicular interconnection to each other, plates 108 extend from plates 14–17 at a 45° angle and thus extend from plates 20–23 and also the cylindrical perimeter or walls defining grinding chamber 26 at a 90° or perpendicular angle. It can then be appreciated that ground material following the perimeter of chamber 26 would encounter and impinge upon plate 108 and thus would be deflected inwardly and away from plates 14–17. Further, due to the angular relationship of plates 108 with respect to plates 14–17 and the longitudinal positioning of deflectors 106 intermediate shaft 44 and the tangential extent of rotors 48–50, plate 108 does not deflect the ground material inwardly into grinding chamber 26 along a radial line but rather along a chord. Thus, the ground material which impinges upon deflectors 106 does not tend to collect thereon but tends to move inwardly into the grinding area of mill 10. The inward movement of material caused by deflectors 106 insures that the deflected material may be impinged by grinding rotors 48–50 and that the deflected material hits and is hit by other material circulating in grinding chamber 26 around and adjacent to grinding rotors 48–50 to increase the grinding action of mill 10.

Figure 5:
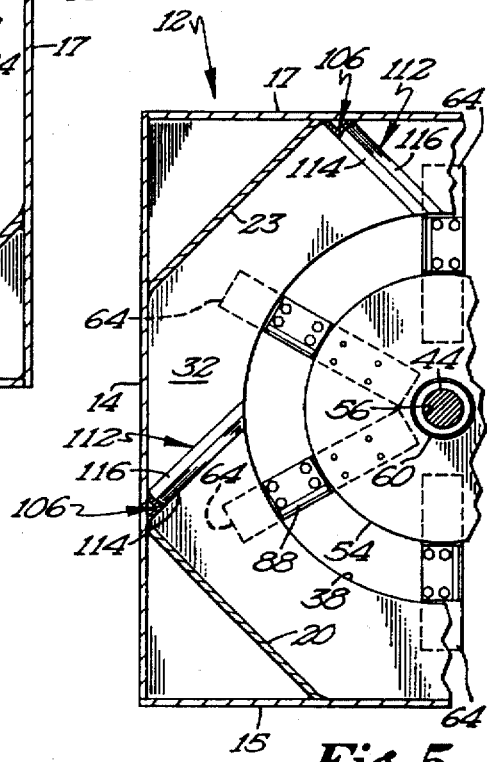
FIG. 5 shows a partial, cross-sectional view of an alternate embodiment of a garbage grinding mill according to the preferred teachings of the present invention as though taken along view lines 5—5 of FIG. 2.
Figure 4:
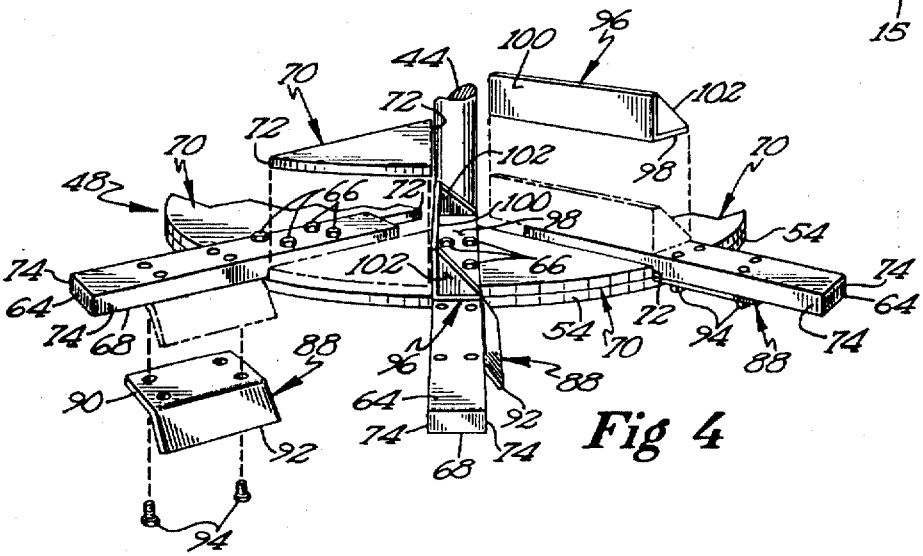
FIG. 4 shows a partial, exploded view of the garbage grinding mill of FIG. 1.
Figure 6:
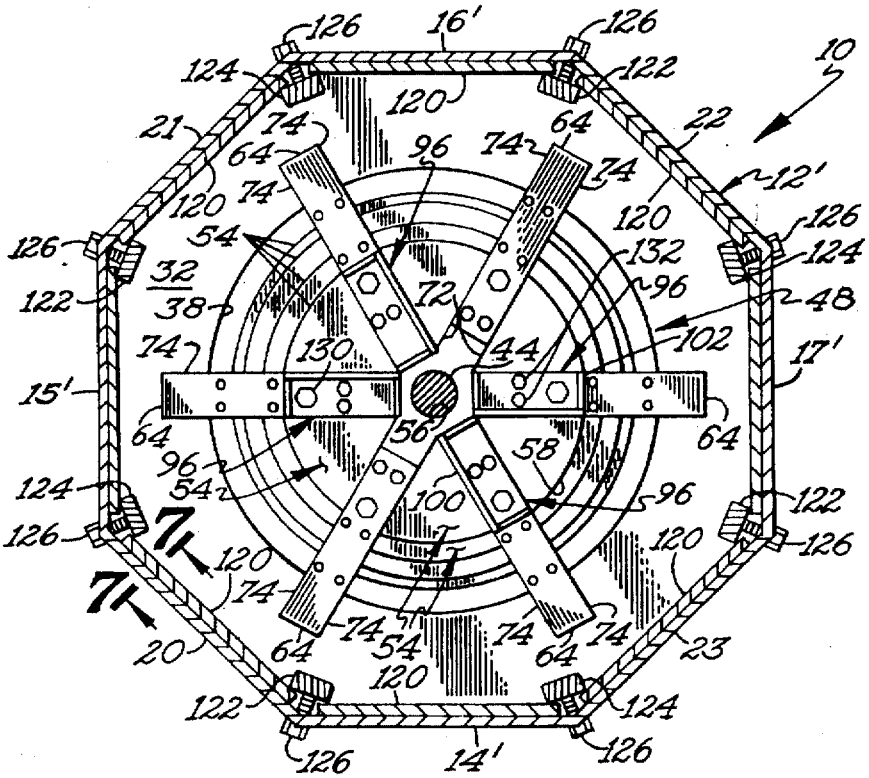
FIG. 6 shows a cross-sectional view of an alternate embodiment of a garbage grinding mill according to the preferred teachings of the present invention.
Figure 7:
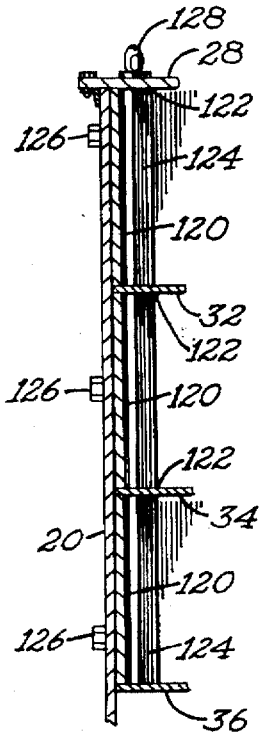
FIG. 7 shows a cross-sectional view of the garbage grinding mill of FIG. 6 according to section line 7—7 of FIG. 6.
Figure 8:
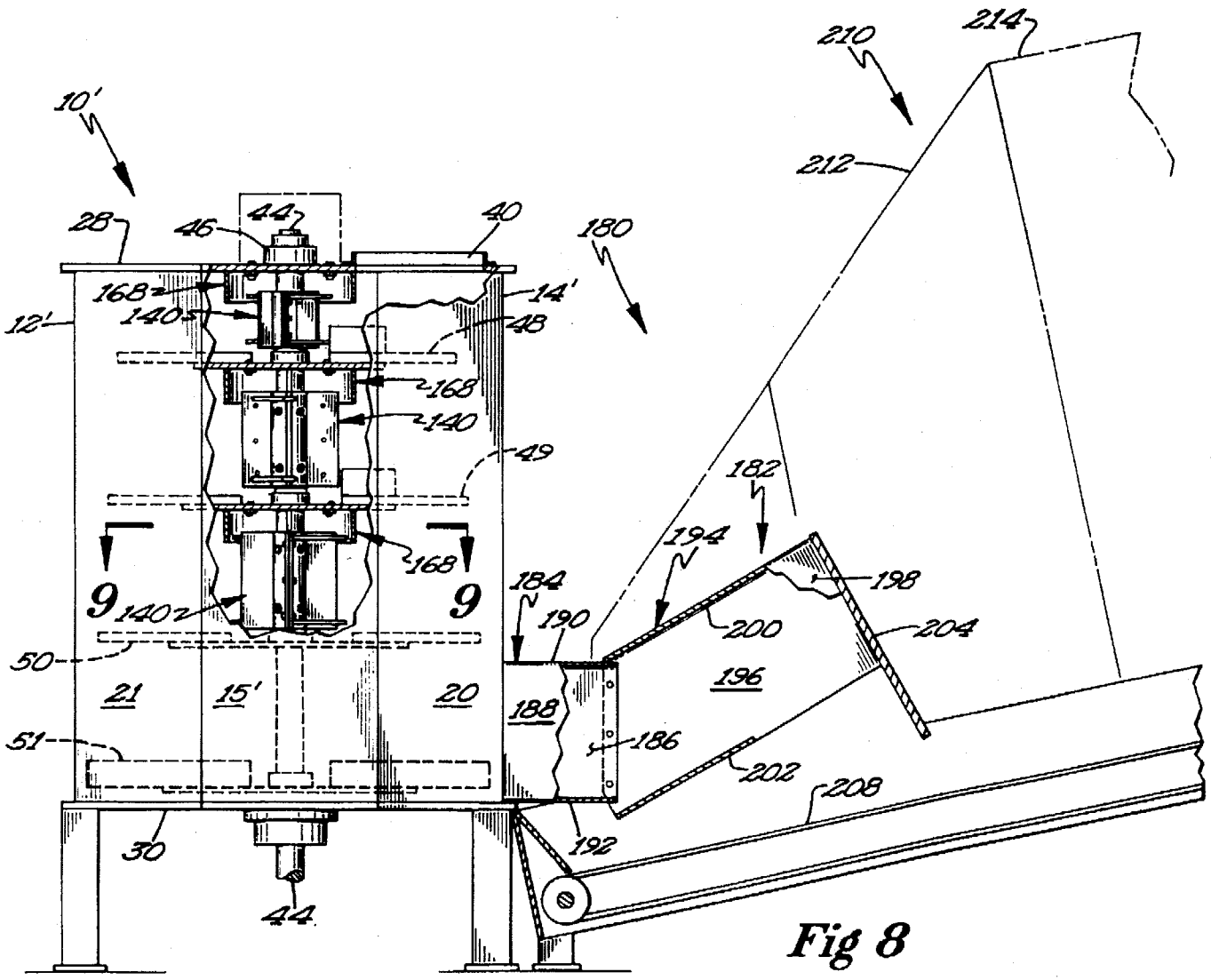
FIG. 8 shows a side view of an alternate embodiment of a garbage grinding mill according to the preferred teachings of the present invention, with portions broken away to show constructional details.
Figure 9:
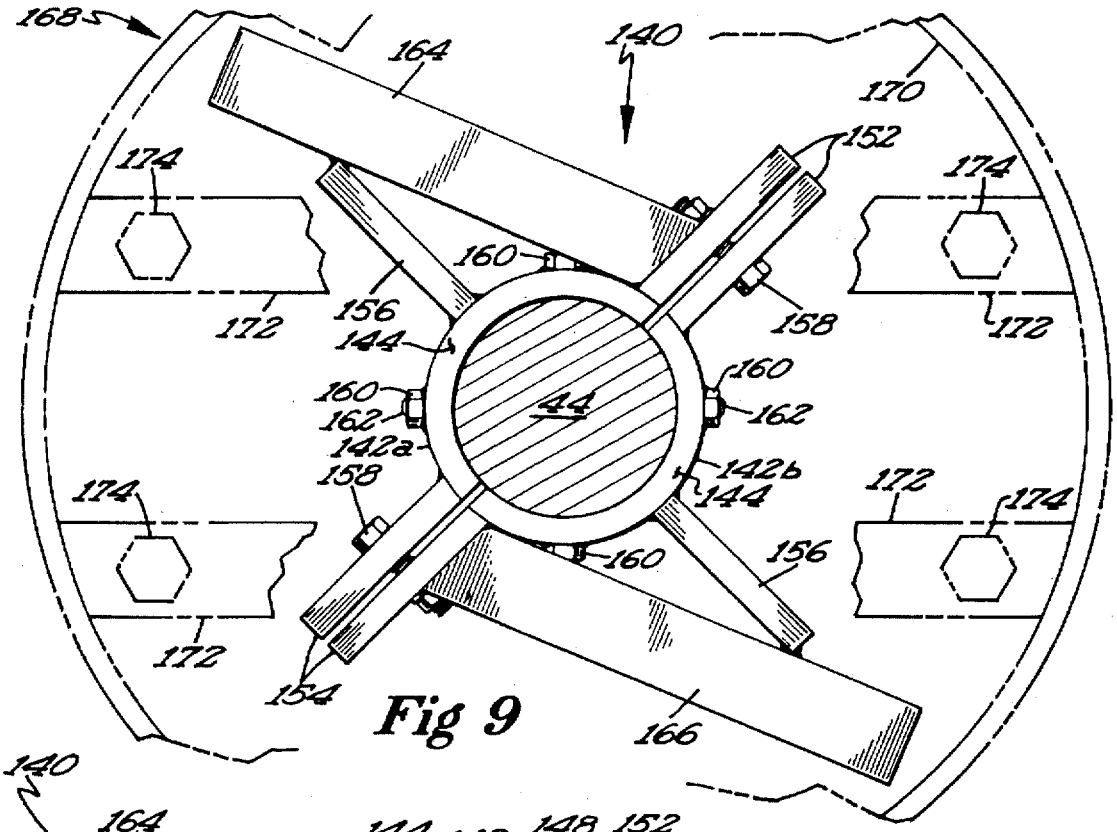
FIG. 9 shows a cross-sectional view of the garbage grinding mill of FIG. 8 according to section line 9—9 of FIG. 8.
Figure 10:
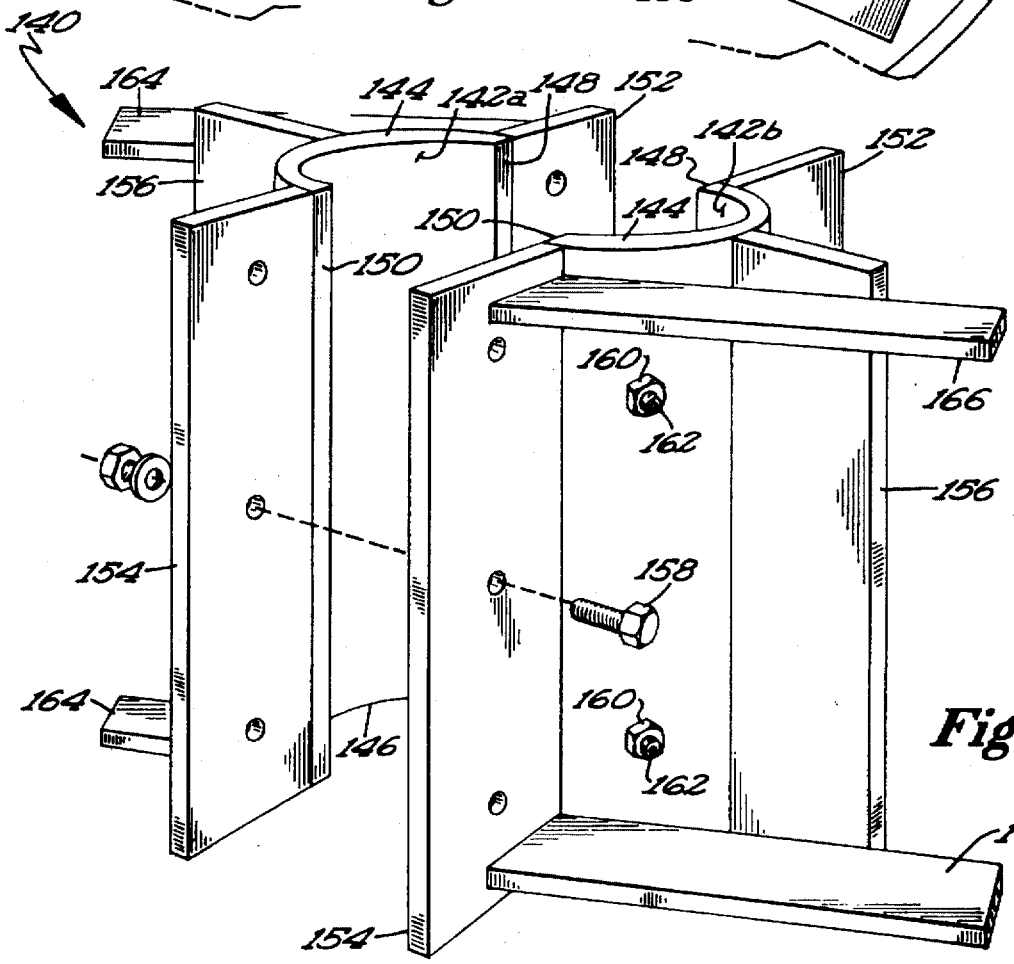
FIG. 10 shows an exploded perspective view of the anti-wrap provisions of the garbage grinding mill of FIG. 8.
Figure 11:
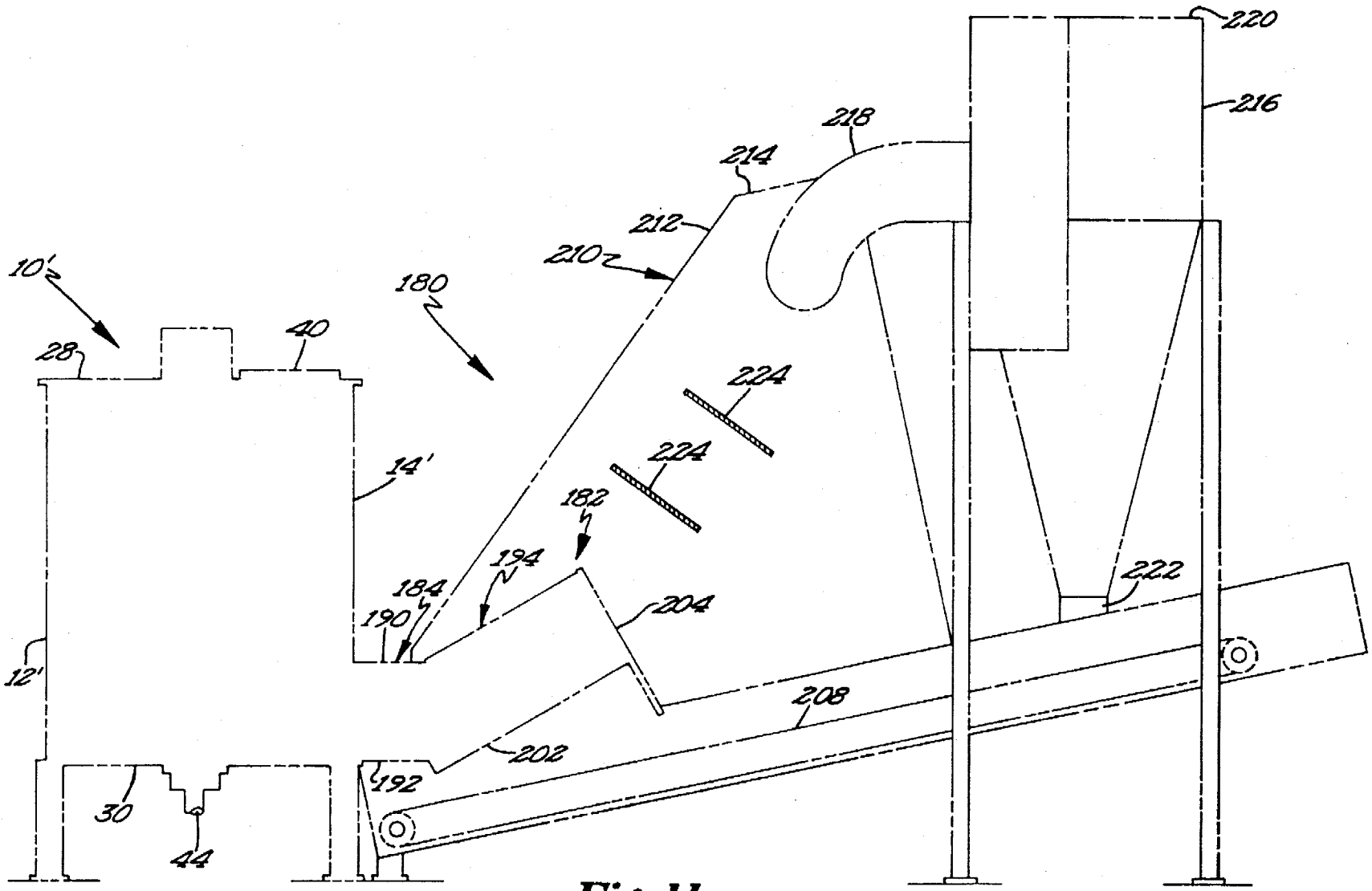
FIG. 11 shows a diagramatic sectional view of the air classification system of the garbage grinding mill of FIG. 8.

In an alternate embodiment of mill 10 according to the teachings of the present invention, deflectors 112 are provided for deflecting material from adjacent top plate 28 and shelves 32 and 34 and above grinding rotors 48–50 towards the rotating grinding rotors 48–50 during operation of mill 10. In the preferred form, deflectors 112 are provided attached to the lower surfaces of top plate 28 and shelves 32 and 34 inside chamber 26 and intermediate top plate 28 and shelves 32 and 34 and grinding rotors 48–50 which in the preferred form is above grinding rotors 48–50 respectively. In the most preferred form, deflectors 112 are formed of angle iron of a length to fit between plates 14–17 and apertures 38 of shelves 32 and 34. Deflectors 112 generally include first and second plates 114 and 116 integrally connected along their first edges at right angles and having equal widths. In the most preferred form, deflectors 106 and 112 are formed from the same stock material. The free, second edges of plates 114 and 116 of deflectors 112 are interconnected to the lower surfaces of top plate 28 and shelves 32 and 34 such as by welding. In the most preferred form, four deflectors 112 are provided radially spaced equadistant around chamber 26 for each grinding rotor 48–50, specifically extending generally radially inwardly from deflectors 106, and particularly extending inwardly at an angle of 10° from the radial in a direction of the rotation of grinding rotors 48–50 which in FIG. 5 of the drawings is clockwise. It should be noted that the number of deflectors 112 provided should not restrict the flying of material around in grinding chamber 26 and the grinding action caused by the sharp edges of ground material hitting each other.

It is believed that the particular form and location of deflectors 112 according to the teachings of the present invention are advantageous. Specifically, due to the equal width of plates 114 and 116 and their perpendicular interconnection to each other, plates 114 extend from top plate 28 and shelves 32 and 34 at a 45° angle and thus do not deflect the ground material downwardly into grinding chamber along an axial line but rather at an angle. Further, due to the angular relationship of deflectors 112 with respect to a radial direction, deflectors 112 do not deflect the ground material inwardly into grinding chamber 26 along a radial line but rather along a chord. Thus, the ground material which impinges upon deflectors 112 does not tend to collect thereon but tends to move downwardly and inwardly into the grinding area of mill 10. The downward and inward movement of material caused by deflectors 112 insures that the deflected material may be impinged by grinding rotors 48–50 and that the deflected material hits and is hit by other material circulating in grinding chamber 26 around and adjacent to grinding rotors 48–50 to increase the grinding action of mill 10.

It should further be appreciated that deflectors 106 and 112 are formed from stock angle iron which is easily obtainable at low cost and specifically avoids the high capital cost required for special cast components. Additionally, second plates 110 and 116 act as braces for first plates 108 and 114 to prevent first plates 108 and 114 from bending or otherwise moving from forces created by the material engaging deflectors 106 and 112 in the operation of mill 10, with bracing being especially important for plates 108 arranged generally perpendicular to grinding rotors 48–50 and to the path of the material flying around inside of grinding chamber 26.

In an alternate embodiment of mill 10 according to the preferred teachings of the present invention, housing 12' includes 8 flat or planar, generally rectangular plates 14', 20, 15', 21, 16', 22, 17', and 23 which are interconnected by their respective side edges to define a grinding chamber 26 having an octagonal cross section, and in the most preferred form, the sides of the octagonal cross section have equal lengths and have equal angles therebetween. In the preferred form, housing 12' is formed by bending a sheet of steel into the octagonal shape and then welding the free edges of the sheet together to form grinding chamber 26. Housing 12' further includes an elongated, closeable vertical opening providing access to grinding chamber 26.

Mill 10' further includes 24 flat or planar, generally rectangular wear plates 120 of a height generally equal to fit between top plate 28 and shelf 32, between shelves 32 and 34, and between shelves 34 and 36 and a length generally equal to but slightly less than the length of the sides between the side edges of the octagonal cross section of housing 12'.

Apertures 122 are formed in top plate 28, and shelves 32 and 34 at the interconnections of plates 14', 20, 15', 21, 16', 22, 17', and 23. In the preferred form, each aperture 122 has an angular outside edge corresponding to the interconnection of the respective plates 14', 20, 15', 21, 16', 22, 17', and 23, spaced, parallel side edges extending at an angle from plates 14', 20, 15', 21, 16', 22, 17', and 23 on opposite sides of their interconnections, and an inside edge extending perpendicularly between the side edges.

Mill 10 further includes 8 elongated, vertical bars 124 vertically slideably received in apertures 122 of top plate 28, and shelves 32 and 34 at each of the interconnections of plates 14', 20, 15', 21, 16', 22, 17', and 23. In the most preferred form, bars 124 are of stock material and have a rectangular cross section of a size and shape complementary to and for vertical slideable receipt in apertures 122.

It should be noted that each of bars 124 extend over the adjoining vertical side edges of wear plates 120, with an elongated vertical space existing between the adjoining vertical side edges of wear plates 120 due to the lesser length of wear plates 120 as versus plates 14', 20, 15', 21, 16', 22, 17', and 23 defining the sides of grinding chamber 26. A plurality of bolts 126 extend through housing 12' and are threadably received in bars 124 for holding bars 124 in place and for sandwiching the adjoining vertical side edges of wear plates 120 between housing 12' and bars 124. A ring 128 can be provided on the upper ends of each bar 124 to allow ease of insertion or removal of bars 124 such as by the use of a crane or other lifting device.

It can be appreciated that during operation of mill 10 according to the preferred teachings of the present invention, ground material impacts the sides of grinding chamber 26 which over time results in wear. Mill 10 according to the teachings of the present invention provides replaceable wear plates 120 which are then subject to such wear caused by the grinding operation and which prevent such wear to housing 12'. Thus, with timely replacement of wear plates 120, housing 12' is not subject to wear from internal, grinding forces but only from external, environmental forces.

Specifically, after wear plates 120 have been worn to a point requiring replacement, bolts 126 are removed from mill 10. Bars 124 may then be vertically raised from apertures 122 and out of mill 10. After removal of bars 124, wear plates 120 are not retained in housing 12' but can be tipped between top plate 28 and shelf 32, between shelves 32 and 34, and between shelves 34 and 36 for passage around rotors 48, 49, and 50 through the vertical opening of grinding chamber 26. After the worn wear plates 120 have been removed, new wear plates 120 can be positioned against plates 14', 20, 15', 21, 16', 22, 17', and 23 and bars 124 inserted into apertures 122 and fixed in place by bolts 126.

It can then be appreciated that due to the flat or planar nature of wear plates 120, wear plates 120 may be cut from stock sheets of material. In addition to ease of manufacture, this is particularly advantageous as wear plates 120 can be formed of material which is extremely resistant to abrasion to provide a very high degree of wearability, more so that if the wear plates had to be bent, casted, or welded.

In addition to providing a very unique method of holding and fixing wear plates 120 inside of housing 12', bars 124 are advantageous in that they deflect material from adjacent the perimeter of grinding chamber 26 towards the rotating grinding rotors 48–50 during operation of mill 10 much in the same manner as deflectors 106. It should then be noted that initially the unworn sides of bars 124 as shown in the drawings do not extend at the same angle from grinding chamber 26 as do plates 108 of deflectors 106. However, as the inside corners of bars 124 wear away, the worn sides of bars 124 approximate the angle of plates 108. It can be appreciated that the corners are relatively easy to wear away but as wear continues, more and more surface area is required to be worn away and the rate of wear decreases.

It should be noted that bolts 126 prevent bars 124 from moving vertically upwardly. Further, when tightened, bolts 126 draw bars 124 tightly against plates 120 and thus drawing plates 120 tightly against housing 12' and sandwich plates 120 between bars 124 and housing 12'. Thus, plates 120 are held flush and tightly against housing 12' to prevent relative movement or rattling of plates 120 relative to housing 12' during operation of mill 10.

In the most preferred form, mill 10 includes a cylindrical shroud located between shelf 36 and bottom plate 30 encircling rotor 51. This shroud increases the efficiency of air movement by rotor 51 through outlet opening 42 as well as protect plates 14', 20, 15', 21, 16', 22, 17', and 23 from internal wear.

Furthermore, in the preferred form, bracing structures 70 of rotors 48 and 49 have been eliminated. Further, bolts 66 have been replaced by a first bolt 130 of relatively high shear strength and second and third shear bolts 132 of lesser shear strength than bolt 130, with first bolt 130 located at a first radial distance from shaft 44 and second and .third bolts 132 located at a second radial distance from shaft 44. In the most preferred form, the first radial distance is greater than the second radial distance. The advantage of this attachment arrangement is that in the event that arms 64 of rotors 48–50 should strike a relatively solid object, second and third bolts 132 are allowed to be sheared such that arm 64 is allowed to pivot out of the way of the solid object about first bolt 130. Previously, if arms 64 engaged such a solid object, arms 64 would be subject to bending or breaking if bolts 66 held. On the other hand, if bolts 66 sheared, the sheared off arm 64 as well as the solid object would fly around in mill 10 potentially harming other arms 64 and/or housing 12. With the present invention, arms 64 are allowed to give to prevent damage thereto but are retained on respective rotors 48–50 by first bolt 130 such that it does not potentially harm the remaining components of mill 10.

It is further believed that the construction of mill 10 according to the preferred teachings of the present invention is particularly advantageous. For example, wear plates 120, bars 124, rotors 48–50, and housing 12 and 12' are formed from stock materials which are easily obtainable at low cost and specifically avoid the high capital cost required for special cast components. Additionally, the components of rotors 48–51 directly abut each other without wedge shaped members and the like located intermediate thereto. Thus, the amount of stress placed upon bolts 66, 94, 130, and 132 is reduced and can be more easily controlled.

In a preferred form of the present invention, mill 10' further includes provisions 140 for combating the problem of material wrapping on shaft 44 rotatable about its axis within grinding chamber 26 defined by housing 12', with grinding chamber 26 being substantially larger than shaft 44. In the most preferred form, anti-wrap provisions 140 include first and second semicylindrical carriers **142*a* and 142*b*. In the most preferred form, carriers 142*a* and 142*b* are fabricated from cutting a steel tube having an inner diameter generally equal to the outside diameter of shaft 44 longitudinally in half. It can then be appreciated that the material removed from the steel tube when it is cut into two halves serves to make the inner diameters of carriers 142*a* and 142*b* to be slightly smaller than the outside diameter of shaft 44. Carriers 142*a* and 142*b* each include upper edges 144, lower edges 146 and first and second free, longitudinally extending edges 148 and 150. First and second wing plates 152 and 154 extend radially outwardly from edges 148 and 150, respectively, of each carrier 142*a* and 142*b*, with wing plates 152 and 154 orientated diametrically opposite to each other or in other words 180° from each other. A third wing plate 156 extends radially outwardly from each of carriers 142*a* and 142*b* intermediate edges 148 and 150, with wing plates 156 being located 90° between plates 152 and 154 in each carrier 142*a* and 142*b* and with plates 156 of carriers 142*a* and 142*b* located 180° from each other. Wing plates 152, 154, and 156 are flat and rectangular in shape and have a longitudinal length generally equal to the longitudinal length of carriers 142*a* and 142*b* between edges 144 and 146 and have a radial width generally equal to the outer diameter of shaft 44 and particularly equal to ⅞ths of the outer diameter of shaft 44. Carriers 142*a* and 142*b* are secured to each other by suitable means such as bolts 158 extending between plates 152 of carriers 142*a* and 142*b* and extending between plates 154 of carriers 142*a* and 142*b*. Thus, shaft 44 is sandwiched between and captured by carriers 142*a* and 142*b*. To insure that carriers 142*a* and 142*b* do not spin or rotate relative to shaft 44, nuts 160 are welded to carriers 142*a* and 142*b* intermediate plates 152, 154, and 156 for threadably receiving set screws 162 which extend through carriers 142*a* and 142*b* and abut with shaft 44**.

It can then be appreciated that when shaft 44 rotates, carriers **142*a* and 142*b* and plates 152, 154, and 156 rotate therewith, with the radial extent of plates 152, 154, and 156 being constant over the axial extent of plates 152, 154, and 156 in the most preferred form and being substantially smaller than grinding chamber 26 defined by housing 12'. It can then be appreciated that anti-wrap provisions 140 are very effective in combating material wrapping on shaft 44. Particularly, the length of material typically has to be at least two times the circumference of the rotating part in order to successfully wrap around the circumference. It can then be appreciated that plates 152, 154, and 156 effectively increase the circumference of shaft 44 by a multiple and in the most preferred form by a multiple of 9. Thus, there will be fewer available items long enough to wrap around the effective circumference of plates 152, 154, and 156 than would be available to wrap around shaft 44. Additionally, rotation of plates 152, 154, and 156 serves as a blower to create positive pressure around shaft 44 which in turn actually repels material away from shaft 44. Shaft 44 without provisions 140 can actually create a negative pressure next to the outside surface of shaft 44 which will attract material to shaft 44 which can wrap thereon. Furthermore, in the event that material should wrap around plates 152, 154, and 156, cavities are created between plates 152, 154, and 156 that enable a cutting tool to get behind and around material wrapped around plates 152, 154, and 156 allowing the wrapped material to be cut away. When material wrapped upon shaft 44 not including provisions 140**, it was very difficult to cut the wrapped material because it was difficult to get behind the wrapped material to cut it off.

In the most preferred form, provisions 140 are provided on shaft 44 between top plate 28 and rotor 48, between rotors 48 and 49, and between rotors 49 and 50. The material passing through aperture 38 of shelf 36 typically will not be of a size that Wrapping around shaft 44 between rotors 50 and 51 is a problem. It can then be appreciated that provisions 140 according to the preferred teachings of the present invention are attached to and carried solely by shaft 44 and particularly are not in any way supported or carried by rotors 48, 49, or 50. In the most preferred form, rotors 48, 49, or 50 are adjustably positioned along shaft 44 by keyways 62 and thus the spacing between top plate 28 and rotors 48, 49, and 50 along shaft 44 are variable. In the most preferred form, the longitudinal length between the axial ends of carriers 142*a* and 142*b* and of plates 152, 154, and 156 is less than or equal to the shortest distance between top plate 28 and rotors 48, 49, or 50. Thus, if rotors 48, 49, or 50 are positioned on shaft 44 at spacings greater than their shortest distance, portions of shaft 44 could be exposed beyond the axial ends of carriers 142*a* and 142*b* and of plates 152, 154, and 156. To prevent any material which wraps or partially wraps around plates 152, 154, and 156 from migrating past either of the axial ends of plates 152, 154, and 156 and/or of carriers 142*a* and 142*b*, first and second end deflector bars 164 and 166 are provided for each carrier 142*a* and 142*b*. Deflector bars 164 are flat and of a generally trapezoid shape having an elongated length which is a multiple of the diameter of shaft 44 and a width which is substantially less than the diameter of shaft 44. Particularly, the ends of deflector bars 164 abut flushly with plate 152, with bars 164 extending tangentially to carrier 142*a* and secured to circumferentially adjacent plate 156 spaced from the outer ends of bars 164. Deflector bars 164 are located adjacent to but spaced slightly axially inward of edges 144 and 146. Similarly, the ends of deflector bars 166 abut flushly with plate 154, with bars 166 extending tangentially to carrier 142*b* and secured to circumferentially adjacent plate 156 spaced from the outer ends of bars 164. Deflector bars 164 are located adjacent to but spaced slightly axially inward of edges 144 and 146. Deflector bars 164 and 166 are arranged parallel to each other and orientated in planes extending perpendicular to the axis of shaft 44. Shaft 44 rotates in a clockwise direction looking downward on mill 10', with deflector bars 164 and 166 having a sweeping motion with the ends of deflector bars 164 and 166 attached to plates 152 and 154, respectively, preceding the remaining portions of deflector bars 164 and 166. Thus, there is less tendency for material to hook itself on deflector bars 164 and 166 but rather will tend to slide therefrom during rotation of shaft 44 and provisions 140 secured thereto. Deflector bars 164 and 166 prevent migration of any wrapped material on provisions 140 axially therebeyond. This is especially important for provisions 140 between top plate 28 and rotor 48 as wrapped material migrating upward upon shaft 44 is especially prone to damaging bearing 46 or the bearing seals thereof.

In the most preferred form, deflectors 168 are secured to the underside of top plate 28 and of rotors 48 and 49 to prevent material from axially entering the upper axial end of provisions 140 between wing plates 152, 154, and 156 of provisions 140. In the most preferred form, deflectors 168 include a cylindrical member 170 having a diameter larger than provisions 140 and a radius generally equal to the spacing between the axis of shaft 44 and inlet opening 40 in the most preferred form. Deflectors 168 further include first and second, parallel, attachment bars 172 extending across the upper axial end of cylindrical member 170 along a chord of cylindrical member 170 and on opposite sides of shaft 44. Bars 172 can be attached to the underside of top plate 28 and rotors 48 and 49 by any suitable means such as by bolts 174. Thus, shaft 44 and provisions 140 attached thereto rotate about its axis relative to deflector 168 of top plate 28, whereas deflectors 168 of rotors 48 and 49 rotate with shaft 44 about its axis. Deflector 168 of top plate 28 is especially important to prevent the momentum of material entering mill 10' through inlet opening 40 from carrying the material adjacent and generally parallel to top plate 28 and axially entering the upper axial end between wing plates 152, 154, and 156. Additionally, deflectors 168 can have an axial extent or length to cover any exposed portions of shaft 44 beyond the upper axial end of provisions 140. Particularly, the upper axial ends of provisions 140 can extend to any axial depth inside of deflectors 168 according to the axial spacing of deflectors 168 from rotors 48, 49, or 50. Thus, deflectors 168 prevent movement of material radially toward the exposed portions of shaft 44 located therein while deflector bars 164 and 166 prevent material from migrating axially upwardly toward the exposed portions of shaft 44 located within deflectors 168. Thus, all portions of shaft 44 between top plate 28 and rotor 50 can be protected from wrapping by provisions 140 and deflectors 168 even though the axial placement of rotors 48, 49, and 50 along shaft 44 can be adjusted.

In a preferred form of the present invention, mill 10' further includes a system 180 for deflecting projectiles and classifying air exiting from outlet opening 42. Particularly, system 180 includes a projectile deflection device 182 connected to the outlet opening 42 of mill 10'. Particularly, device 182 includes a first chute portion 184 including a first side plate 186 extending from outlet opening 42 generally linearly and contiguous to plate 23 and a second side plate 188 extending from outlet opening 42 generally parallel to side plate 186 and from the edge of plate 20 defining outlet opening 42. Portion 184 further includes a top plate 190 extending perpendicularly between plates 186' and 188 and perpendicularly to plate 14'. Portion 184 further includes a bottom plate 192 extending perpendicularly between plates 186 and 188 and generally linearly and contiguous to bottom plate 30. It can then be appreciated that first chute portion 184 extends from outlet opening 42 generally tangentially to rotor 51 and includes an outer end opposite to outlet opening 42.

Device 182 further includes a second chute portion 194 including a first side plate 196, a second side plate 198, a top plate 200, a bottom plate 202, and an outer end plate 204. Side plates 196 and 198 are parallel to and spaced from each other and extend generally perpendicularly between plates 200 and 202. End plate 204 extends generally perpendicular to plates 196 and 198, and at an angle in the order of 90° and preferably perpendicular to plate 200 and has a height substantially greater and particularly approximately 50% greater than the height between plates 200 and 202. Bottom plate 200 is spaced from end plate 204 to define an outlet, with the outer end of the outlet being at the same vertical extent as top plate 190 of first chute portion 184 and of the top of outlet opening 42 and with end plate 204 extending beyond the outlet of chute portion 194. The cross section of second chute portion 194 is slightly larger than the cross section of first chute portion 184 and particularly the height between plates 200 and 202 of portion 194 is greater than the height between plates 190 and 192 of portion 184. Second chute portion 194 is secured to first chute portion 184 to extend at an upward acute angle in the order of 30° therefrom. Specifically, top plate 200 extends contiguously upward from top plate 190. Bottom plate 202 is at an acute angle to bottom plate 192, with the end of bottom plate 202 opposite to end plate 204 being spaced below bottom plate 192 at the outlet of first chute portion 184 to define a gap between first and second chute portions 184 and 194 at their interconnection. Side plates 196 and 198 extend generally contiguously and linearly from side plates 186 and 188, respectively.

Mill 10' further includes a conveyor 208 positioned below the outlet of second chute portion 194 and the gap between chute portions 184 and 194. A closed plenum 210 is mounted to the initial portion of conveyor 208 and generally includes an initial portion 212 having rectangular cross sections of an increasing size and a terminal portion 214 having rectangular cross sections of a constant size. Suitable provisions such as flaps allow conveyor 208 to enter plenum 210 and for conveyor 208 and ground material thereon to exit plenum 210 but to generally prevent the escape of air and any ground material suspended therein. Deflection device 182 extends into the initial end of portion 212 with the outlet of second chute portion 194 and the gap between chute portions 184 and 194 located within portion 212 of plenum 210. In the most preferred form, end plate 204 is positioned at generally half the length along conveyor 208 of portion 212.

Mill 10' further includes a cyclonic separator 216 of a standard design. Separator 216 includes an inlet 218 in fluid communication with the uppermost portion of portion 214 of plenum 210 farthest from the outlet opening 42 of mill 10'. The air is allowed to exit a top opening 220 in separator 216 whereas the separated ground material is allowed to exit through an outlet 222 onto conveyor 208 located below outlet 222 and after plenum 210.

It can be appreciated that rotor 51 of mill 10' ejects a stream of air and ground material through outlet opening 42 of mill 10' in a generally linear path tangential to rotor 51 at very high speeds and force, with heavy ground materials such as small pieces of steel exiting as projectiles which could damage the material transfer means such as a conveyor and/or which poses a safety hazard to people in the vicinity of mill 10'. According to the teachings of the present invention, the stream of air and the ground material exiting outlet opening 42 travel generally tangentially into first chute portion 184 and then is deflected upward by bottom plate 202 (while contained by plates 196, 198, and 202) before exiting of the air and ground material entrapped therein through the outlet of chute portion 194. Projectiles exiting outlet opening 42 are deflected off bottom plate 202 which is arranged at an acute angle to the linear path of the projectiles and directed into end plate 204 from which they are deflected back into the stream of air and ground material and are depleted of enough energy that they are carried out of the outlet of chute portion 194 with the stream of air and ground material and fall onto conveyor 208. Thus, the incline of chute portion 194 absorbs the kinetic energy of the projectiles to avoid damage to conveyor 208 and/or personnel in the area of mill 10'. It can be appreciated that the angle of end plate 204 is arranged at an angle of 90° to plate 202 in the preferred form but can be arranged at other angles in the order of 90° depending upon the ricochet desired from end plate 204.

Due to the increased volume of plenum 210 versus that of deflection device 182, the air stream is allowed to expand and slow down causing a pressure drop. Due to this reduction in speed, the air stream is unable to entrap much of the ground material therein, with the "heavies" and the majority of the "lights" of the ground material dropping out of the air stream in plenum 210 and onto conveyor 208 located below plenum 210 and before the air stream enters separator 216. The dropping of the ground material from the air stream can be enhanced by providing a tortuous path for the air stream such as by utilizing baffles 224 positioned in plenum 210 to change the direction of the air stream, with the ground material not able to change direction as readily as the air stream and thus leaving the air stream and dropping under gravitational forces onto conveyor 208. It can then be appreciated that the air stream entering separator 216 through inlet 218 includes considerably less ground material than the air stream exiting from the outlet of chute portion 194, allowing separator 216 to be of a smaller size and to operate at higher efficiencies.

It should be noted that the gap between chute portions 184 and 194 allows material such as water or ground material at the shutdown of mill 10' which does not have enough kinetic energy to flow through the outlet of portion 194 to flow down bottom plate 202 through the gap and onto conveyor 208.

Now that the basic teachings of the present invention have been explained, many extensions and variations may be obvious to one having ordinary skill in the art. For example, a dust separator can be provided at the output end of mill 10 in addition to or alternately to nozzles 104 of the most preferred form.

Although the preferred teachings of the present invention has been explained for grinding garbage and mill 10 and 10' is believed to be particularly advantageous therefor, mill 10 and 10' may be utilized for grinding like material. For example, mill 10 and 10' may be utilized for grinding tires and teeth may be provided on arms 64, in chamber 26, and/or on bars 126 to aid in cutting rubber.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for combating material from wrapping around a shaft rotatable about an axis inside of a hollow chamber of a mill substantially larger than the shaft, with the mill including means rotatable with the shaft for resizing the material, comprising, in combination: a multiplicity of flat wing plates, with the wing plates each having first and second planar faces and inner and outer edges, with the width of the wing plates between the inner and outer edges being multiple times greater than the thickness of the wing plates between the first and second faces; and means for mounting the wing plates extending from the resizing means parallel to the shaft and at circumferentially spaced locations around the shaft for rotation with the shaft and orientated with the first and second faces extending generally radially from the shaft, with the outer edges being at a radial extent from the shaft substantially smaller than the chamber but greater than the inner edges, with the wing plates serving as a blower to create positive pressure around the shaft when rotating, with the radial extent of the outer edges of the wing plates effectively increasing the circumference of the shaft and of the length of the material which could potentially wrap thereon.

2. The anti-wrap device of claim 1 wherein the wing plates have at least one axial end; and wherein the anti-wrap device further comprises, in combination: means located adjacent to the axial end of the wing plates for preventing material from axially migrating from the wing plates beyond the axial end of the wing plates.

3. The anti-wrap device of claim 2 wherein the axially migrating preventing means comprises a flat bar having an elongated length substantially greater than the diameter of the shaft, with the bar extending tangentially to the shaft and oriented in a plane perpendicular to the axis of the shaft.

4. The anti-wrap device of claim 3 wherein the bar has a first end and a second end, with the distance between the first and second ends of the bar defining the elongated length, with the first end abutting with a first wing plate of the multiplicity of wing plates, with the bar secured to a second wing plate of the multiplicity of wing plates spaced from the second end of the bar, with the second wing plate being circumferentially adjacent the first wing plate.

5. The anti-wrap device of claim 2 further comprising, in combination: a deflector for preventing material from axially entering the axial end between the wing plates.

6. The anti-wrap device of claim 5 wherein the deflector comprises a cylindrical member including first and second axial ends and having an axial extent between the first and second axial ends and having a diameter larger than the diameter of the radial extent of the wing plates and smaller than the chamber, with the axial end of the wing plates located between the first and second axial ends and within the axial extent of the cylindrical member.

7. The anti-wrap device of claim 6 wherein the deflector rotates with the shaft about the axis.

8. For a mill having an outlet opening through which a stream of air and entrapped material and projectiles exits in a generally linear path, with the projectiles exiting the mill at exit speeds and force which pose potential damage and safety hazards, a device comprising, in combination: a chute portion for receiving the stream of air, entrapped material and projectiles exiting the mill with the projectiles traveling at the exit speeds and force, with the chute portion having at least a deflector plate and an end plate, with the deflector plate arranged at an acute angle to the linear path, with the end plate being spaced from the deflector plate to define an outlet therebetween, with the end plate arranged at an angle of generally 90° to the deflector plate, with the projectiles exiting in the generally linear path being deflected off the deflector plate towards the end plate before exiting the outlet of the chute portion to absorb kinetic energy of the projectiles before the projectiles exit the outlet of the chute portion to avoid damage by the projectiles after exiting the outlet of the chute portion.

9. The device of claim 8 further comprising, in combination: a plenum having an interior volume substantially greater than the chute portion, with the chute extending from outside of the plenum into the interior volume of the plenum with the outlet of the chute portion being in communication with the interior volume of the plenum, with the stream of air slowing down in the plenum to release at least portions of the entrapped material; and a material separator having an inlet in fluid communication with the plenum.

10. The device of claim 9 further comprising, in combination: flat slate baffles in the plenum creating a tortuous path for the air stream in the plenum from the outlet of the chute portion to the inlet of the material separator to enhance dropping of the entrapped material from the stream of air.

11. The device of claim 9 wherein the material separator includes a material outlet; and wherein the device further comprises, in combination: a conveyor for the material, with the conveyor located below and for receipt of material directly from each of the outlet of the chute portion, the plenum, and the outlet of the separator.

12. For a mill having an outlet opening through which a stream of air and entrapped material and projectiles exits in a generally linear path, a device comprising, in combination: a chute portion having at least a deflector plate, an end plate, and a top plate, with the top plate and the deflector plate being spaced, with the end plate being secured to the top plate, with the deflector plate arranged at an acute angle to the linear path, with the end plate being spaced from the deflector plate to define an outlet therebetween, with the end plate having a height substantially greater than the height between the top plate and the deflector plate and extending beyond the outlet, with the projectiles exiting in the generally linear path being deflected off the deflector plate towards the end plate before exiting the outlet of the chute portion.

13. Device for combating material from wrapping around a shaft rotatable about an axis inside of a hollow chamber substantially larger than the shaft comprising, in combination: a multiplicity of flat wing plates, with the wing plates each having first and second planar faces and inner and outer edges, with the width of the wing plates between the inner and outer edges being a multiple of the thickness of the wing plates between the first and second faces; and means for mounting the wing plates at circumferentially spaced locations around the shaft for rotation with the shaft and orientated with the first and second faces extending generally radially from the shaft, with the outer edges being at a radial extent from the shaft substantially smaller than the chamber but greater than the inner edges, with the wing plates serving as a blower to create positive pressure around the shaft when rotating, with the radial extent of the outer edges of the wing plates effectively increasing the circumference of the shaft and of the length of the material which could potentially wrap thereon; and at least a first rotor mounted to the shaft for rotation with the shaft; wherein the mounting means is carried solely by the shaft independent of the rotor and comprises, in combination: first and second semicylindrical carriers; and means for securing the first and second semicylindrical carriers together and sandwiching the shaft therebetween.

14. Device for combating material from wrapping around a shaft rotatable about an axis inside of a hollow chamber substantially larger than the shaft comprising, in combination: a multiplicity of flat wing plates, with the wing plates each having first and second planar faces and inner and outer edges, with the width of the wing plates between the inner and outer edges being a multiple of the thickness of the wing plates between the first and second faces; and means for mounting the wing plates at circumferentially spaced locations around the shaft for rotation with the shaft and orientated with the first and second faces extending generally radially from the shaft, with the outer edges being at a radial extent from the shaft substantially smaller than the chamber but greater than the inner edges, with the wing plates serving as a blower to create positive pressure around the shaft when rotating, with the radial extent of the outer edges of the wing plates effectively increasing the circumference of the shaft and of the length of the material which could potentially wrap thereon; wherein the mounting means comprises, in combination: first and second semicylindrical carriers each including first and second longitudinally extending edges, and means for securing the first and second semicylindrical carriers together and sandwiching the shaft therebetween; wherein the multiplicity of wing plates comprises, in combination: first wing plates extending radially outward from the first longitudinally extending edges of each of the first and second semicylindrical carriers, and second wing plates extending radially outward from the second longitudinally extending edges of each of the first and second semicylindrical carriers; and wherein the securing means comprises means for securing the first wings of the first and second semicylindrical carriers together and for securing the second wings of the first and second semicylindrical carriers together.

15. The anti-wrap device of claim 1 wherein the radial extent of the wing plates from the shaft is constant over the axial extent of the wing plates.

16. For a mill including a shaft rotatable about an axis inside of a hollow chamber substantially larger than the shaft, with the hollow chamber having an outlet opening through which a stream of air and entrapped material exits, a device comprising, in combination: a plenum having an interior volume, with the outlet opening of the mill being in communication with the interior volume of the plenum, with the stream of air slowing down in the plenum to release at least portions of the entrapped material; a material separator having an inlet in fluid communication with the plenum; a multiplicity of flat wing plates; and means for mounting the wing plates orientated to extend radially from the shaft to a radial extent from the shaft substantially smaller than the chamber at circumferentially spaced locations around and for rotation with the shaft, with the radial extent of the wing plates effectively increasing the circumference of the shaft and of the length of the material which could potentially wrap thereon.

17. The device of claim 8 wherein the mill includes a shaft rotatable about an axis inside of a hollow chamber substantially larger than the shaft; and wherein the device further comprises, in combination: a multiplicity of flat wing plates; and means for mounting the wing plates orientated to extend radially from the shaft to a radial extent from the shaft substantially smaller than the chamber at circumferentially spaced locations around and for rotation with the shaft, with the radial extent of the wing plates effectively increasing the circumference of the shaft and of the length of the material which could potentially wrap thereon.

18. Device for combating material from wrapping around a shaft rotatable about an axis inside of a hollow chamber substantially larger than the shaft comprising, in combination: a multiplicity of wing plates, with the wing plates having at least one axial end; means for mounting the wing plates orientated to extend radially from the shaft to a radial extent from the shaft substantially smaller than the chamber at circumferentially spaced locations around the shaft, with the radial extent of the wing plates effectively increasing the circumference of the shaft and of the length of the material which could potentially wrap thereon; and means located adjacent to the axial end of the wing plates for preventing material from axially migrating from the wing plates beyond the axial end of the wing plates comprising a flat bar having an elongated length substantially greater than the diameter of the shaft, with the bar extending tangentially to the shaft and oriented in a plane perpendicular to the axis of the shaft.

19. The device of claim 8 wherein the mill includes a rotatable rotor, with the generally linear path being tangential to the rotor.

20. The device of claim 8 wherein the chute portion comprises a plurality of solid plates interconnected together to form a passage for the stream of air and entrapped material and projectiles from the mill to the outlet, with the plurality of solid plates including the deflector plate and the end plate.

21. The device of claim 12 wherein the chute portion further includes first and second, spaced side plates, with the top plate and the deflector plate extending between the first and second side plates, with the end plate being secured to the first and second side plates.

22. The device of claim 21 wherein the end plate is arranged at an angle of generally 90° to the deflector plate.

23. The anti-wrap device of claim 1 wherein the mounting means comprises means for mounting the wing plates with the inner and outer edges being generally parallel to the shaft.

* * * * *